United States Patent [19]

Otema

[11] Patent Number: 4,634,010

[45] Date of Patent: Jan. 6, 1987

[54] STORE FIXTURES

[76] Inventor: Martin Otema, 51 Pine Ridge Drive, Scarborough, Ontario, Canada, MIM 2X6

[21] Appl. No.: 676,166

[22] Filed: Nov. 29, 1984

[51] Int. Cl.[4] ..... A47E 5/08

[52] U.S. Cl. ..... 211/96; 211/90; 211/103

[58] Field of Search ..... 211/96, 90, 94, 103, 211/106, 48, 105.1, 168, 169; 108/108, 152

[56] References Cited

U.S. PATENT DOCUMENTS

| | | | |
|---|---|---|---|
| 1,879,679 | 9/1932 | Clover | 211/96 |
| 2,802,577 | 8/1957 | Moore | 211/96 |
| 2,926,824 | 3/1960 | St. Clair | 211/96 X |
| 3,330,418 | 7/1967 | Schneider | 211/96 X |
| 3,610,425 | 10/1971 | Madey | 248/220.3 |
| 3,935,949 | 2/1976 | Cohen | 211/168 |
| 4,215,784 | 8/1980 | Perkins | 211/123 X |
| 4,381,715 | 5/1983 | Forman | 108/152 |

FOREIGN PATENT DOCUMENTS

| | | | |
|---|---|---|---|
| 305797 | 11/1968 | Sweden | 211/103 |
| 401387 | 5/1966 | Switzerland | 211/94 |

*Primary Examiner*—Robert W. Gibson, Jr.
*Attorney, Agent, or Firm*—Rogers, Bereskin & Parr

[57] ABSTRACT

Improvements in store fixtures are disclosed. In one aspect of the invention, a pant rack is provided by a series of modular display units which are individually supported on a rail and each of which includes wire supports for carrying a pair of pants to be displayed. Another aspect of the invention concerns the fact that the garment supports are pivotally coupled to a frame of the display rack by offset pivot pins arranged so that the racks always return to a central position. A further aspect of the invention concerns an arrangement for supporting the rail which carries the pant racks.

6 Claims, 5 Drawing Figures

STORE FIXTURES

FIELD OF THE INVENTION

This invention relates generally to store fixtures such as display racks, shelving and the like.

BACKGROUND OF THE INVENTION

The invention has been devised primarily (but not exclusively) in the environment of display racks for use in the retail sale of clothing articles, such as pants, ladies skirts and the like. This type of article is typically displayed on a wire support carried by a frame which is either free standing or secured to a wall. The wire support will have a horizontal limb which extends generally horizontally from the frame and over which the article is draped, and an inclined limb which extends inwardly from the outer end of the horizontal limb and which is attached back to the frame. The frame will normally carry a series of similar wire supports disposed in parallel planes, so that an array of garments (e.g. of different sizes) can be displayed together.

The wire supports in a display rack of this type (often called a "pant rack") are normally disposed relatively closely adjacent one another in parallel planes so that a large number of garments can be displayed in a small space. The supports are normally individually pivotted to the frame of the rack so adjacent supports can be spread apart to gain access to a particular garment. In practice, in a store, what tends to happen is that a customer attempting to examine a particular garment will push aside an adjacent garment which means that the support carrying that garment and all of the supports behind it will pivot back with respect to the frame. Unless the customer takes the trouble to return all of those frames to their initial positions (which is unlikely) the result is that the parallelism of the supports is lost and different supports project outwardly from the frame at different angles creating an untidy appearance.

Appearance can also be disadvantageously affected by the fact that gaps tend to appear in the array of articles carried by the rack as individual garments are sold. In practice, it is often found that certain type of garments will sell more quickly than another garment on the same rack; for example, garments of a particular color or size may sell more quickly than other garments. Store personnel are then faced with the need to restock the wire supports individually. Generally, a determined arrangement of garments will be required on the rack (e.g. with particular sizes and/or colors grouped together) which means that it will be necessary for the store personnel to carefully pay attention to the restocking of each individual support with the garment of the correct type.

An object of the present invention is to provide improvements and store fixtures which address these problems and which also provide other advantages.

BRIEF DESCRIPTION OF THE INVENTION

According to one aspect of the invention, there is provided a display rack comprising at least one rail secured in a generally horizontal position on and spaced outwardly from a fixed structure and an array of article supports provided by a series of similar article display units disposed side by side on said rail. Each display unit includes a base, a plurality of individual article supports carried by the base and hook means on the base engaging the rail and suspending the unit from the rail with the article supports projecting from the base and forming part of said array.

In other words, the array of article supports is provided by modular article display units hooked onto the rail of the rack so that the units are individually removable from the rail, for example, for restocking or the like.

In practice, this allows a particular unit to be individually removed from the rack and taken, say to a stock room for restocking. Not only does this avoid the need for individual articles to be brought from a stock room for loading onto the display rack but restocking can be carried out away from the sales area of the store.

Each individual article display units may comprise a frame forming a said base and a plurality of individual wire garment supports coupled to the frame. Preferably, the article display units will be identical with one another so that they can be interchanged on the rail, and will be designed to provide an aesthetically pleasing appearance, even when unloaded.

A second aspect of the invention provides a display rack, including a base and a plurality of article supports each extending outwardly from the base and oriented to normally adopt a position in a predetermined generally vertical plane when the rack is in use. Each support is pivotally coupled to the base by upper and lower pivot pins received in corresponding openings in the base. The openings are arranged so that, when the support is disposed in its predetermined vertical plane, the upper pivot pin is offset in a direction away from the base with respect to a vertical axis containing the lower pivot pin, so that the support tends to return to its said plane after being deflected therefrom about the pivot pins.

In other words, the offset of the pivot pins for each article support has a self-centering effect so that the support always tends to return to the predetermined vertical plane in which the support is designed to lie. Normally, this plane will be disposed at right angles to the general plane of the base. This self-centering effect avoids the problem discussed previously of untidy appearance due to individual garment supports having been pushed aside by customers in selecting a particular article.

A still further aspect of the invention provides a store fixture which includes a rail secured to a fixed structure by brackets extending outwardly from the structure. The rail has, throughout its length, a uniform cross-sectional shape defined by a channel having an open mouth directed towards the structure and flanges along both sides of the mouth. Each bracket is provided with a fitment at an outer end of the bracket which is shaped to fit snugly inside the rail at any position therealong with the bracket extending between the rail flanges.

In this arrangement, the rail effectively conceals the connection means between it and the brackets. At the same time, the brackets can be positioned at any selected locations along the length of the rail. This avoids problems which occur with prior art fixtures where the brackets have to be spaced horizontally on predetermined centers, for example, on wall studs or standards. In prior art arrangements in which the brackets must be secured at predetermined positions along the rail, any slight disconformity between the centers of the studs and the centers of the rail fastening points causes extreme difficulty in installation. Obstructions on the rail preventing hangers or other brackets sliding along the rail are also avoided.

The rail may form part of a display rack of the form discussed above or of some other store fixture structure. For example, the rail could be incorporated in a shelf.

BRIEF DESCRIPTION OF DRAWINGS

In order that the invention may be more clearly understood, reference will now be made to the accompanying drawings which illustrate preferred embodiments of the invention by way of example, and in which.

Figure 1:
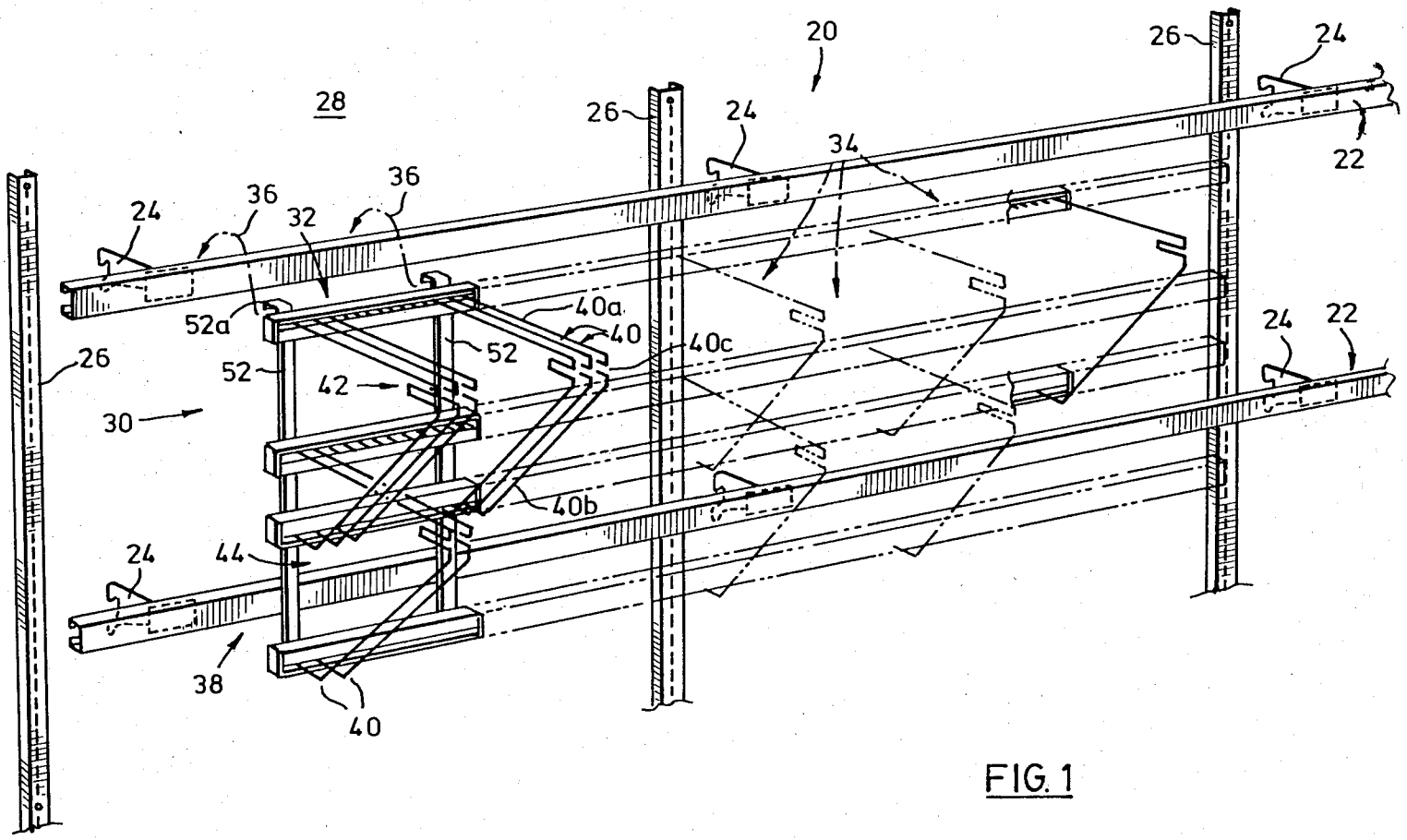
FIG. 1 is a perspective view of a display rack having modular article display units in accordance with one aspect of the invention.

Referring first to FIG. 1, a display rack is generally denoted by reference numeral 20 and includes a pair of horizontal rails 22 secured by brackets 24 to vertical standards 26 on a wall 28. The standards are spaced across the wall on predetermined centers and are formed with the slots in selected ones of which the brackets 24 can be interlocked in essentially conventional fashion. The specific cross-sectional shape of the rails 22 and the manner in which the brackets 24 engage the rails will be described later. The rack includes an array of article supports generally denoted by reference numeral 30 and provided by a series of essentially identical modular article display units, one of which is shown in full lines at 32, and adjacent ones of which are generally indicated in ghost outline at 34. Unit 32 is typical of all of the units and will be described below, with reference to FIGS. 2 and 3. However, before referring to those views, it can be seen from FIG. 1 that unit 32 is designed to hook onto the top of the two rails 22 as indicated by the arrows 36 and will rest against the bottom rail generally in a vertical orientation.

Unit 32 includes a base in the form of a generally rectangular frame 38, and a plurality of individual article supports, some of which are shown at 40 in FIG. 1. It will be seen that each unit 32 is, in fact, provided by two rows of article supports denoted 42 and 44, arranged one above the other with the individual supports in the respective rows interleaved.

Referring to one of the supports 40 by way of example, it will be seen that each support is made of a length of circular section wire (see particularly FIGS. 2 and 3) shaped to define a horizontal limb 40*a* which extends outwardly from the base frame 38, and an inclined limb 40*b* which extends inwardly from the outer end of limb 40*a* back to frame 38. Between the two limbs, the support is inwardly deflected to form a generally rectangular slot 40*c* through a garment such as a pair of pants can be looped so that the garment tends to be frictionally retained on the support.

Figure 2:
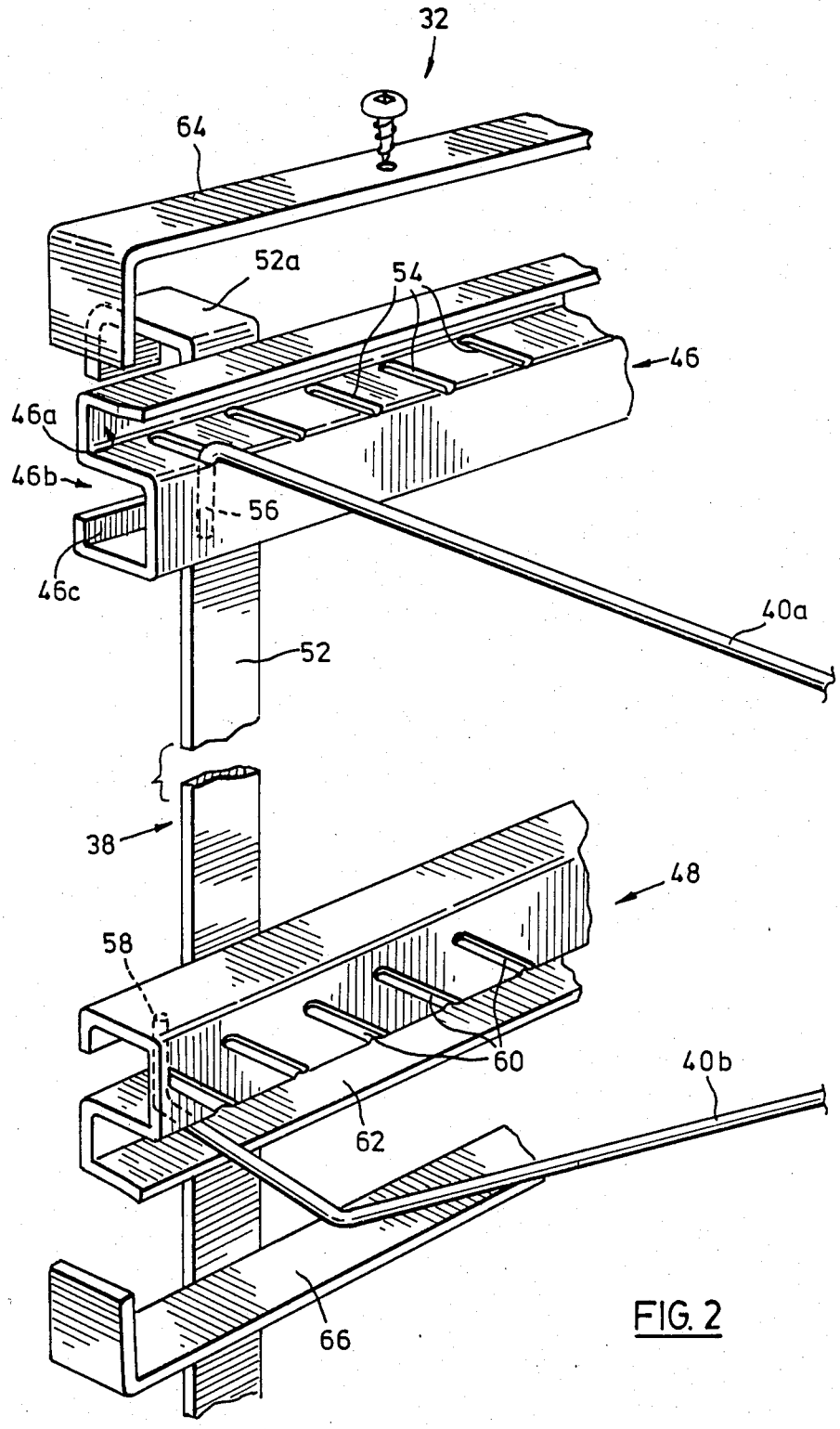
FIG. 2 is a perspective view of part of one of the units of FIG. 1 and illustrates a second aspect of the invention.
Figures 3, 3A:
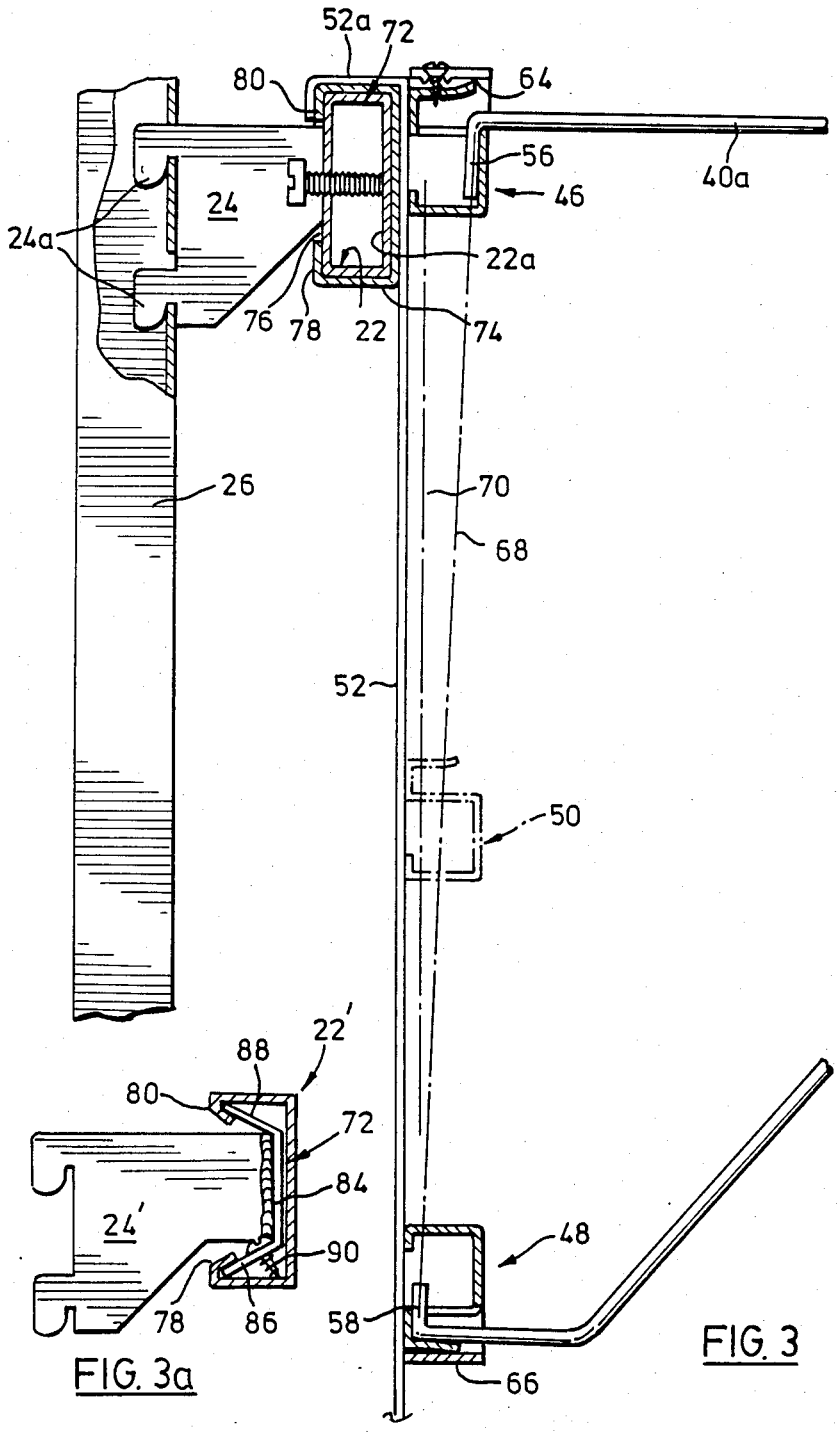
FIG. 3 is a vertical sectional view on line III—III of FIG. 2.
FIG. 3*a* illustrates a detail modification of part of FIG. 3.

FIGS. 2 and 3 illustrate parts of the article display unit 32 in more detail and show portions of a typical one of the article supports 40. As can be seen from those views (and from FIG. 1) each article support extends between a pair of horizontal members of the frame 38 of unit 32. The two frame members for the upper row 42 of article supports are shown in full lines at 46 and 48 in each of FIGS. 2 and 3. In the latter view, the upper member for the lower row 44 of article supports is shown in ghost outline at 50; the members for the two rows are essentially the same and only the members for the upper row have therefore been shown in detail. From FIG. 1, it can be seen that the two pairs of members are essentially parallel to one another and are joined by a pair of vertical frame members 52, each of which has a hook 52*a* at its upper end designed to fit over and snugly embrace the top rail 22. One of those vertical members is also visible in each of FIGS. 2 and 3. The four horizontal members as members 46 and 48 are welded to the vertical members 52.

The two horizontal frame members 46 and 48 are identical but are installed with one inverted with respect to the other. Each member is generally S-shaped defining two oppositely directed channels indicated by reference numerals 46*a* and 46*b* in the case of the upper member shown in FIGS. 2 and 3. With a continued reference to that member as typical of both, the upper channel is open at the front while the lower channel is partially obstructed by a flange 46*c* which extends out from the bottom wall of the member in that orientation. The wall between the two channels 46*a* and 46*b* is formed with a series of spaced parallel slots, one for each of the articles supporting elements 40. The slots extend over substantially the entire height of the wall in directions at right angles to the length of the member.

Each article supporting member 40 includes respective upper and lower pivot pins which are denoted 56 and 58 respectively in the case of the member 40 shown in FIGS. 2 and 3. The pivot pins are received in the respective openings represented by the slots 54 in the upper member and the corresponding slots (denoted 60) and the lower member. The upper pin 56 extends downwardly through the relevant slot while the lower pin extends upwardly. In this particular embodiment, the respective pivot pins are formed by deflected end portions of the top limb 40*a* and the inclined limb 40*b* of the wire which forms the article support 40. The slots 54 in the upper member 46 of the frame 38 extend into the base of channel 46*b* so as to define radiussed seats 54*a* in which the horizontal limb 40*a* of the respective article supports can sit when in their normal positions. In the illustrated embodiment, the normal positions of the elements are, as shown in FIG. 1, in generally vertical planes normal to the general plane of the frame 38.

When a particular article support is loaded by an article, the respective upper and lower limbs of the article support will be pressed down by the weight of the article. In the case of the upper limb 40*a*, the end of that limb adjacent with pivot pin 56 will be urged into the relevant seat 54*a*. In the case of the other limb 40*b*, the portion of the limb adjacent to pivot pin 58 is generally horizontally disposed and will lie in contact with the bottom wall of the lower member 48, which is denoted 62 in FIGS. 2 and 3.

Respective top and bottom caps 64 and 66 are secured by screws, one of which is shown at 68, to the members 46 and 48 so that the article supports 40 cannot be accidentally disengaged from within the relevant openings in the members. As can best be seen from FIG. 3, the top and bottom limbs respectively of the members 46 and 48 are slightly shorter than the overall depth of the members themselves so as to facilitate installation of the article supports 40. However, the caps 64 and 66 extend over the full depth of the members, thereby preventing accidental disengagement of the article supports. Referring now more particularly to FIG. 3, it will be seen that the two pivot pins 56 and 58 are disposed at a common axis denoted 68, and that the openings 54 and 60 in the respective frame members 46 and 48 are arranged so that, when the article support 40 is disposed on its normal position generally at right angles to the plane of the frame 38, the upper pivot pin 56 is offset in a direction away from the frame with respect to a vertical axis denoted 70 in FIG. 3 about which the lower pivot pin 58 turns. This offset causes the article support to always tend to return to its normal plane after it has been pivotted out of that plane in use as discussed above.

In the particular embodiment being described, the two pivot pins 56 and 58 are on a common axis 68 for ease of manufacture; however, this is not essential within the broad scope of the invention and it may be preferred for the two pivot pins to be offset on parallel axes. It should also be noted that the slots 54 and 60 in the frame members 46 and 48 respectively could be replaced by plain openings in those members disposed at the required offset. However, again for ease of manufacture, the slot arrangement is preferred because it avoids the necessity to accurately position offset openings as would be necessary if plain openings were employed. With the slot arrangement, the required offset may be considered to occur naturally because the weight of the article on the support tends to cause it to tip forward.

It will, of course, be understood that, in a display rack, there will normally be a large number of similar supports disposed side by side in parallel planes and the effect of the arrangement provided by the invention is such that those supports will always be properly oriented in those parallel planes and will return to those planes after deflection. In this way, the overall appearance and aesthetic appeal of the rack is considerably improved as compared with the prior art. The individual article supports will be made of wire as discussed previously and the frame 38 and associated components of steel. All of the components will be chrome-plated for aesthetic appeal.

FIG. 3 also illustrates the manner in which the rails 22 of the rack (see FIG. 1) are supported from the vertical standards 26. As discussed previously, the standards and the brackets 24 which interfit therewith are essentially of conventional form. The standards each have a vertical row of slots and the brackets 24 have tangs **24*a* which are designed to be removably engaged in the slots. Welded to the outer end of each bracket 24 and extending generally at right angles to the plane of the bracket is a coupling fitment which is denoted 72 in FIG. 3. Fitment 72 is a section of hollow rectangular section tubular steel and is of a relatively short length as can best be seen in FIG. 1. As best shown in FIG. 3, fitment 72 fits snugly inside the rail 22. The rail itself is of uniform cross-sectional shape throughout its length and defines a channel 74 perceiving fitment 72. The channel has an open mouth 76 directed towards the wall or other structure to which the standards 26 are secured and respective flanges 78 and 80 extend along both sides of the mouth to constrain the fitment 72**.

It will be appreciated that this arrangement provides for a concealed connection between rail 22 and the bracket 24 so that the frontal appearance of the rail (FIG. 1) as presented to a customer is clean and aesthetically appealling. Also, the brackets can be positioned at any longitudinal position along the rails simply by sliding the fitments 72 of the bracket to a selected position. In some cases, the snug fit between the fitment and the rail may be sufficient to retain the bracket in its final position relative to the rail. However, it may be preferred to provide some form of additional retaining means. In the illustrated embodiment, this is accomplished by means of a screw threaded bolt 82 which extends forwardly through a screw threaded opening in the rear face of fitment 72 (the face nearest the standards 26). Screw 82 extends forwardly through the fitment so that its outer end bears against the inner surface of the front wall of the fitment, denoted **72*a***. By tightening the bolt against that wall, the wall can be caused to bulge slightly and effectively lock the fitment to the rail.

FIG. **3*a* illustrates an alternative embodiment of the invention and primed reference numerals have been used in FIG. 3*a* to denote parts corresponding with parts shown in previous views. In this case, the bracket 24' is the same as the bracket 24 of FIG. 3 and carries a somewhat different fitment 72'. Rail 22' is essentially the same as the rail shown in the previous views except in that the flanges 78 and 80 of the rail are inwardly angled as shown in FIG. 3*a***.

Fitment 72' comprises a channel section member having a base 84 which lies in contact with the base of the channel defining the rail, and limbs 86 and 88 which extend outwardly from the base 84 in inclined positions selected so that the outer edges of the limbs engaged behind the flanges 78 and 80. This arrangement may offer advantages in terms of ease of manufacture and avoidance of possible problems in terms of jamming of the fitment within the rail, due, for example, to surface imperfections on either component. These problems may be more likely to occur in an arrangement of the type shown in FIG. 3 in which almost the entire internal surface of the rail makes contact with the fitment.

In the FIG. **3*a* embodiment, the fitment can be locked at an adjusted position along the length of rail 22' by means of a screw 90** which extends through a threaded opening in the fitment and has a pointed end capable of slightly indenting the internal surface of the rail for securing the fitment to the rail.

Figure 4:
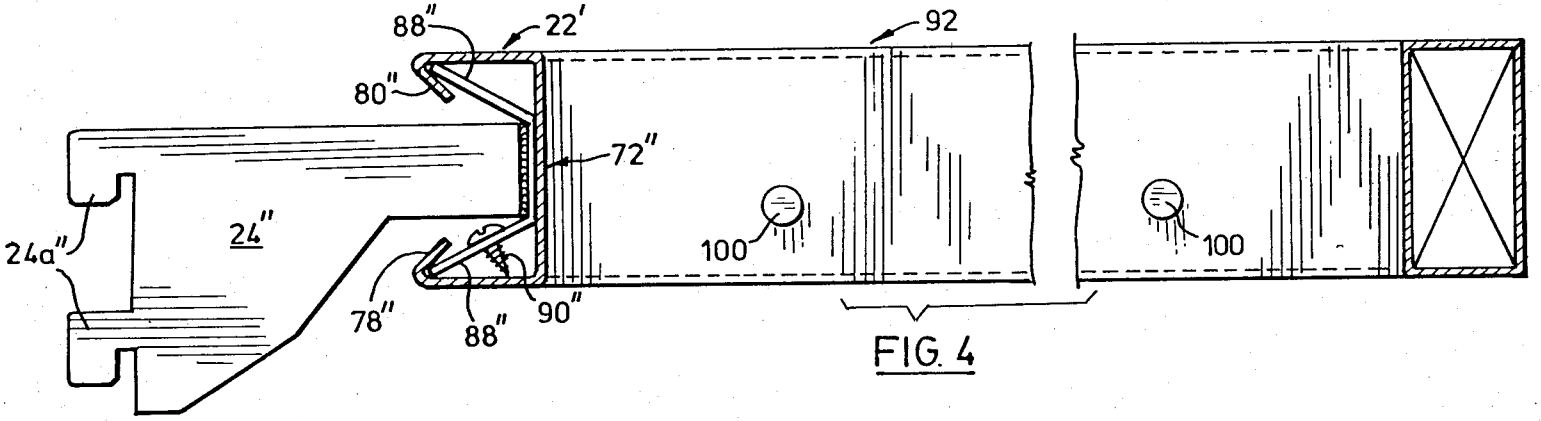
FIG. 4 is a vertical sectional view illustrating the application of the principle of the arrangement of FIG. 3*a* to a shelf-structure; and, FIG. 5 is an exploded perspective view from the left in FIG. 4.
Figure 5:
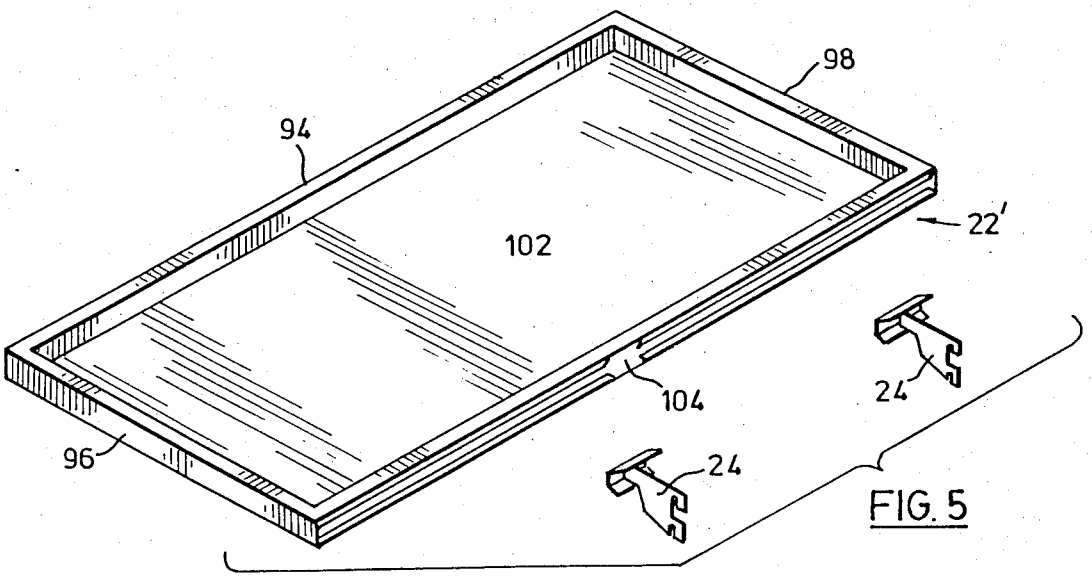

FIGS. 4 and 5 illustrates a further aspect of the invention in which the rail fastening arrangement previously described is applied to other forms of store fixtures (in this embodiment a shelf arrangement). Double prime reference numerals have been used in FIGS. 4 and 5 to denote parts corresponding with parts shown in previous views.

In this embodiment, a rail 22" is incorporated in a shelf denoted 92 and forms one side of the shelf. Details of the construction of the rest of the shelf have not been shown in FIGS. 4 and 5 because they form no part of the present invention. It is sufficient to note that the shelf has a frame comprising the rail 22" and three other frame members 94, 96 and 98 and that the frame members 96 and 98 carry supports 100 for a shelf panel 102.

Typically, a shelf of the form shown in FIG. 4 would be supported by two brackets 24" (FIG. 5), each of which would be of essentially the same form as the brackets shown at 24' in FIG. **3*a* and have the same fitments as fitments 72'. As indicated at 104, in FIG. 5, the flanges of rail 22'** are cut away to permit insertion of the fitments during installation.

It will, of course, be understood that the bracket/rail coupling arrangement described previously can be applied to forms of store fixtures other than the specific forms described and that the shelf and rack arrangement referred to are examples only.

Other modifications are also possible within the broad scope of the invention. For example, racks having article supports other than those of the specific form disclosed may be used in the arrangement described primarily with reference to FIGS. 2 and 3. The exact form of the article support will also vary according to the particular article to be displayed. Some examples of articles have been given above; others are towels, tablecloths, sheets and like articles. The arrangement designed to allow the article supports to always return to a determined position may be applied to racks other than modular units of the form shown in FIG. 1. Examples are racks in which the article supports are permanently fixed to a frame or other base (e.g. free standing pant racks) and racks which can be used, say, as a closet organizer in the home. In this latter case, the rack could be designed to be free-standing or as a wall mounted unit. The term "display rack" is to be interpreted broadly as including racks designed primarily for storage purposes.

I claim:

1. A display rack comprising:

at least one rail secured in a generally horizontal position on and spaced outwardly from a fixed structure; and an array of article supports provided by a series of similar article display units disposed side by side on said rail and each comprising a base, a plurality of individual article supports carried by the base and hook means on the base engaging said rail and suspending the unit with said article supports projecting from the base and forming part of said array;

wherein each said article display unit comprises a frame defining said base and including said hook means, and wherein said article supports comprise wire garment supports pivotally coupled to said frame and arranged in upper and lower rows with the supports in the respective rows interleaved to provide for display of garments at two different levels.

2. A display rack as claimed in claim 1, wherein said article display units are all substantially identical with one another, whereby said array comprises a modular assembly of said units.

3. A display rack as claimed in claim 1 wherein the article supports of each said article display units extend outwardly from the base of that unit and are oriented so that each supports normally adopts a position in a predetermined generally vertical plane when the rack is in use, wherein each said support is pivotally coupled to said base by upper and lower pivot pins received in corresponding openings in the base, and wherein said openings are arranged so that when the support is disposed in said predetermined vertical plane, the upper pivot pin is offset in a direction away from said base with respect to a vertical axis containing the lower pivot pin, whereby the support tends to return to said plane after being deflected therefrom about said pivot pins.

4. A store fixture which includes a rail secured to a fixed structure by brackets extending outwardly from the structure, wherein the rail forms part of a shelf structure supported by said brackets and has, throughout its length, a uniform cross-sectional shape defined by a channel having an open mouth directed towards said structure and flanges along both sides of said mouth, and wherein each said bracket is provided with a fitment at an outer end of the bracket shaped to fit snugly inside said rail at any position therealong with the bracket extending between the rail flanges.

5. A store fixture as claimed in claim 4, wherein each said fitment is provided with securing means engageable with said rail for securing the bracket at a fixed position longitudinally of the rail.

6. A store fixture as claimed in claim 4, further comprising an array of article supports provided by a series of similar article display units disposed side by side on said rail and each comprising a base, a plurality of individual article supports carried by the base and hook means on the base engaging said rail and suspending the unit with said article supports projecting from the base and forming part of said array.

* * * * *